US005183034A

United States Patent [19]

Yamasaki et al.

[11] Patent Number: 5,183,034

[45] Date of Patent: Feb. 2, 1993

[54] PORTABLE VIBRATION FINGER PRESSURE MASSAGER

[75] Inventors: Yoshikiyo Yamasaki, Sakai; Shinichiro Fujimoto, Osaka, both of Japan

[73] Assignees: Kabushiki Kaisha Japan Health, Sakai; Kabushiki Kaisha Fuji Iryoki, Osaka, both of Japan

[21] Appl. No.: 813,133

[22] Filed: Dec. 23, 1991

[51] Int. Cl.[5] ..... A61H 1/00

[52] U.S. Cl. ..... 128/36; 128/60; 128/46

[58] Field of Search ..... 128/46, 32, 34, 35, 128/36, 59, 60, 61, 52

[56] References Cited

U.S. PATENT DOCUMENTS 3,671,785 6/1972 Fuchs ..... 128/36
3,993,052 11/1976 Miyahara ..... 128/46
4,777,940 10/1988 Yamasaki ..... 128/46
4,785,798 11/1988 Yamasaki ..... 128/46
4,846,158 7/1989 Teranishi ..... 128/36
5,063,911 11/1991 Teranishi ..... 128/32
5,065,743 11/1991 Sutherland ..... 128/59

*Primary Examiner*—Robert A. Hafer
*Assistant Examiner*—David J. Kenealy
*Attorney, Agent, or Firm*—Flynn, Thiel, Boutell & Tanis

[57] ABSTRACT

A vibrator portable massager having massaging balls which can perform relative swinging motion, and can optionally cause finger pressure massage, vibration or the like. The portable massager has a vibrator structure disposed in each massaging ball, and vibration isolation boards which can absorb noise and vibration are disposed on rotating structure which can rotate the massaging balls. A spring is disposed at the center of a thin shaft to support the massaging ball to provide a stable massage without an uncomfortable feeling.

3 Claims, 4 Drawing Sheets

PORTABLE VIBRATION FINGER PRESSURE MASSAGER

BACKGROUND OF THE INVENTION

1. Field of the Invention

The present invention is directed to a portable finger pressure massager which is provided with a pair of massaging balls which make a swinging motion relative to each other and, more particularly, to a portable vibration finger pressure massager which has massaging balls capable of applying a finger pressure massage, a vibration massage and a vibration finger pressure massage.

2. Description of Prior Art

It has previously been proposed to provide a vibrator-type massaging apparatus or massager-type portable massaging apparatus which includes a pair of massaging balls or elements which have a relative movement and are applied to a distressed part of a user's body.

These conventional massaging apparatuses typically comprise a box-shaped case with a driving worm disposed at a central location therein. A pair of worm gears rotatably engage with opposite sides of the worm and are provided with vertically extending shafts which have massaging balls at the tops thereof. The top portions of these shafts are inclined from the vertical axis of rotation of the worm gears by a fixed angle so that in operation, the massaging balls are put into circular motion relative to each other.

These conventional portable massaging apparatuses as described above typically have disadvantages in that noise and vibration occur between the gears because of the uneven size of the box or the uneven contact ratio of the worm and worm gears.

In order to overcome the problems of noise and vibration, Applicants propose the use of a vibration isolation board as illustrated in FIG. 2. As illustrated in FIG. 1, this vibration isolation board 23 is provided on an upper surface of worm gear 13 so that it engages with the upper surface of the worm gear 13 and an inner surface of the box 14. The vibration isolation board 22 exerts a constant pressure against the worm gear 13 to help reduce the noise and vibration that occurs during the rotation of the worm gear. However, as of the present time, there has not been provided a portable massager which has reduced noise and vibration and yet is capable of providing the three different types of massage, i.e., finger pressure massage, vibration massage and vibration finger pressure massage.

SUMMARY OF THE INVENTION

It is an object of the invention to provide a portable massaging apparatus which is capable of providing finger pressure massage, vibration massage and vibration finger pressure massage, without noise and vibration, by the use of massaging balls which move in a circular fashion relative to each other.

The portable massaging apparatus according to the present invention comprises a pair of worm gears which engage with a worm on opposite sides thereof, a box within which the pair of worm gears are installed to freely rotate, elastic vibration isolating boards which are provided on at least an upper or a lower surface of the worm gears, and massaging balls which are connected to the top of a shaft associated with each worm gear and contain a motor with an eccentric weight provided at an end thereof in order to apply a finger pressure massage to a desired body part of a user. Additionally, a spring can be used to connect the massaging balls with the shaft of the worm gears so that the massaging balls will not bind and pinch the body part of the user during the operation of the massager. A detailed description of the portable massaging apparatus will be given below with respect to the embodiments illustrated in FIGS. 3-9.

DETAILED DESCRIPTION OF THE INVENTION

Figure 1:
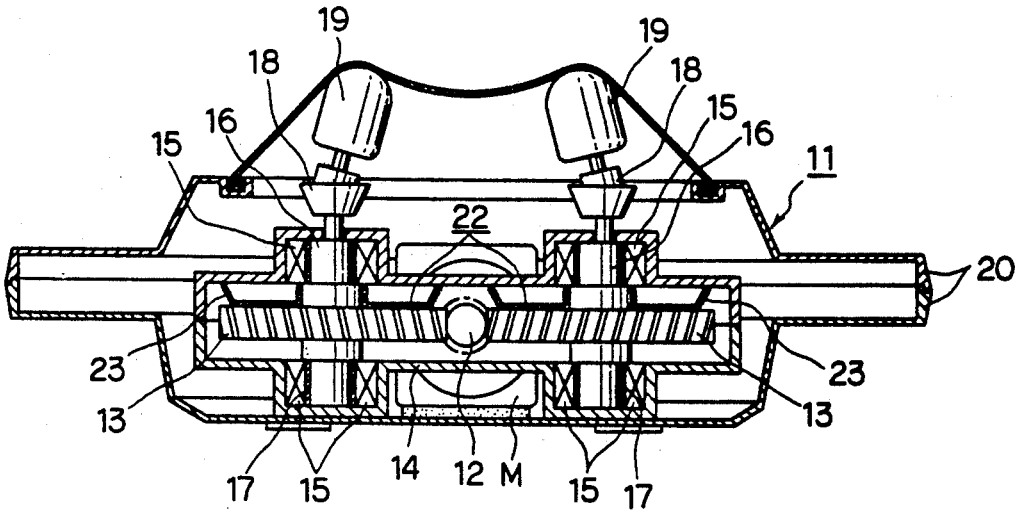
FIG. 1 is a central longitudinal sectional view of a conventional portable massager.
Figure 2:
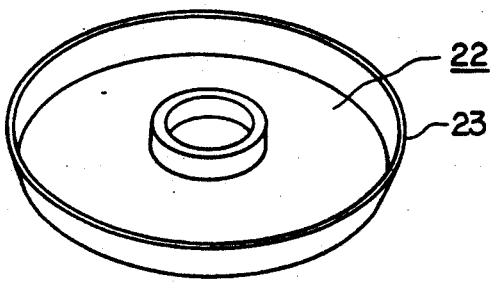
FIG. 2 is a perspective view of a conventional vibration isolation board.
Figure 3:
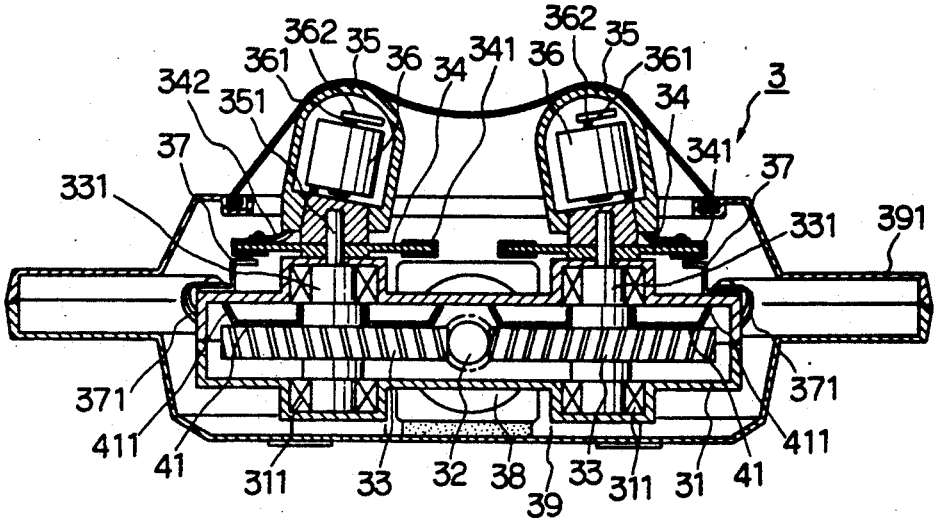
FIG. 3 is a central longitudinal sectional view of an embodiment of a portable massager according to the present invention.
Figure 4:
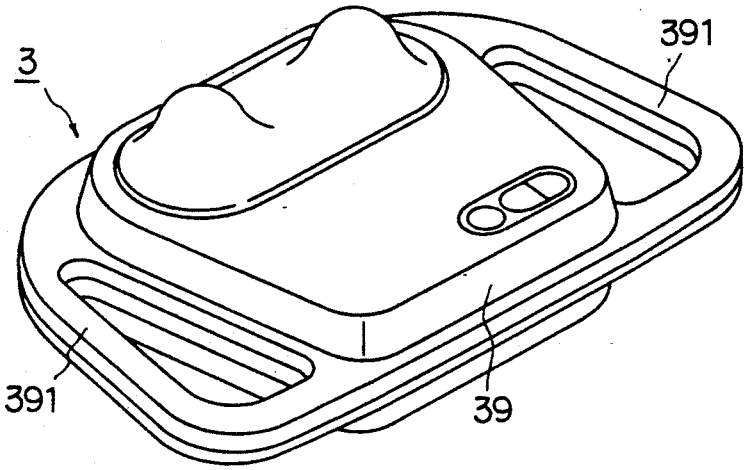
FIG. 4 is a plan view of a portable massager according to the present invention.

As illustrated in FIG. 3, the portable vibration finger pressure massager 3 of the present invention comprises an outer case body 39 in which an opening is provided at an upper portion thereof. A box 31 is provided within the case body 39 and contains a worm 32 provided at a central portion thereof and a pair of worm gears 33 which engage the worm 32 at opposite sides thereof. The worm 32 is coupled to a motor 38 contained in case body 39. The worm gears 33 are mounted for rotational movement in the box 31 and are caused to rotate in opposite directions by the rotation of the worm 32. The box 31 is provided with boss portions at opposed upper and lower surfaces in which a first shaft 331 associated with the worm gear 33 is received. The first shafts 331 are coaxial with the worm gears 33 and are rotated simultaneously through the rotation of the worm gears 33. Bearings 311 are provided in the boss portions of the box 31 and contact the outer surface of the first shaft 331 to support it for rotation therein.

An annular shaped vibration isolating board 411 is provided on one or both of the upper and lower surfaces of the worm gears 33 to minimize noise and vibration associated with the portable massager. The vibration isolating board 411 is made of a flexible material so that its height may be varied and is confined in the space between the upper and/or lower surface of the worm gear 33 and the box 31 and exert a constant stabilizing pressure against the worm gears 33 thereby.

Figure 5:
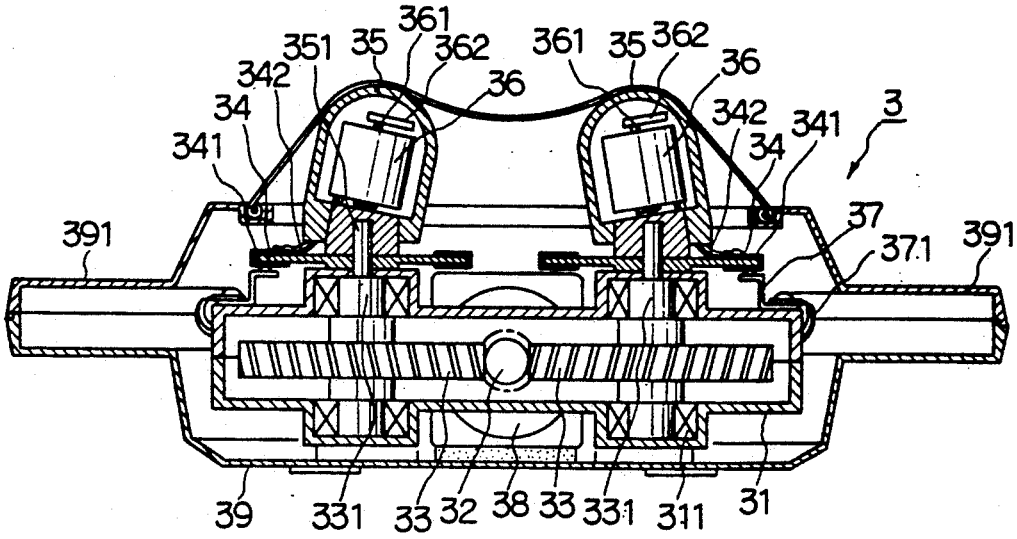
FIG. 5 is a central longitudinal sectional view of a portable massager according to the present invention without the vibration isolating boards in place.
Figure 6:
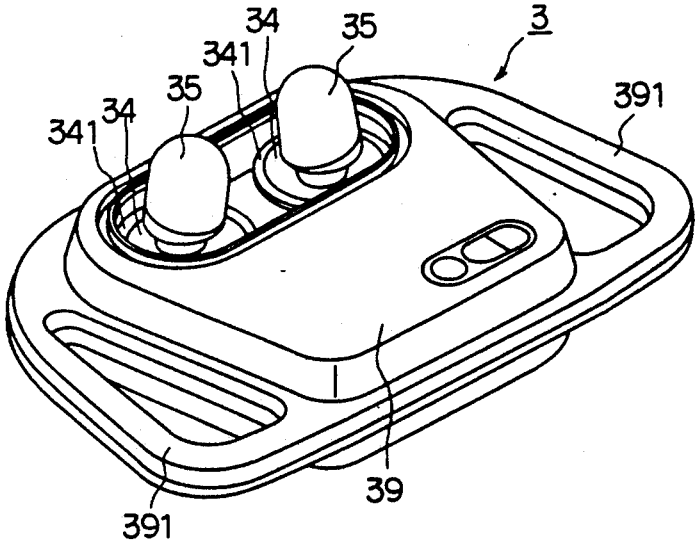
FIG. 6 is a plan view of a portable massager according to the present invention illustrating the orientation of the massaging balls.

In the embodiments of the present invention illustrated in FIGS. 3 and 5, a second smaller shaft 351 is provided at the upper end of the first shaft 331 and extends vertically therefrom. The second smaller shaft 351 is coaxial with the first shaft 331 and the worm gear 33 and rotates in common with them. A rotating disk 34 is affixed to the second shaft 351 and mounted for rotation thereon. The rotating disks 34 are disposed in parallel with the worm gears 33 and have a conductive member 341, such as a copper plate, disposed around the outer edge surfaces thereof. A massaging ball 35 is provided at the end of the second shaft 351 and in contact with an upper surface of the rotating disk 34. The massaging balls 35 have a ball-like member made of an elastic material, such as a synthetic resin or rubber, provided at the outer end thereof and is provided on the second shaft 351 at a constant inclined angle relative to the axis of rotation of the rotating disk 34 and the worm gears 33 such that the massaging balls 35 move along a circular path. A small electric motor 36 is contained within the massaging ball 35. The electric motor 36 has an eccentric weight 362 disposed at the end of a shaft 361 of the motor 36 such that through the eccentric rotation of the weight 362, microvibration is imparted to the massaging ball 35.

Figure 7:
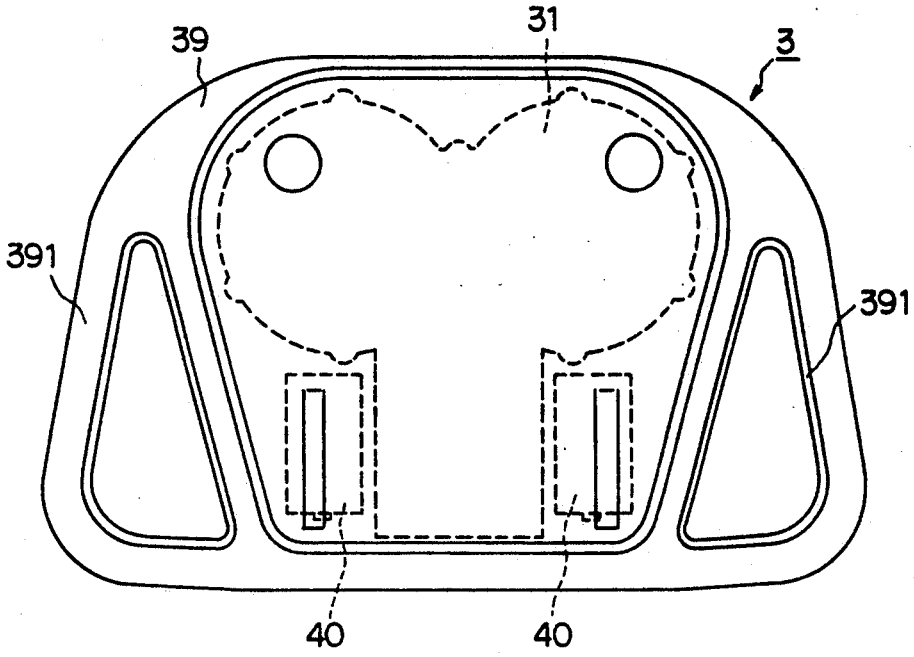
FIG. 7 is a top view of a portable massager according to the present invention.

The wiring 342 of the electric motor 36 is electrically connected to the conductive member 341 provided on the rotating disk 34. An electrical connection panel 37 is affixed to an upper surface of the box 31 in a manner such that it comes into contact with a lower surface of the conductive member 341. Electrical wiring 371 electrically connects the electrical connection member 37 with an external power source 40 such as shown in FIG. 7. The external power source for the small motor 36 is not restricted and can be either AC or DC. Through the provision of electrical conductive members 341 around the edge of the rotating disk 34, continuous electrical contact is made between the small electrical motor 36 and the external power source 40 during the rotation of the rotating disk 34.

Figure 8:
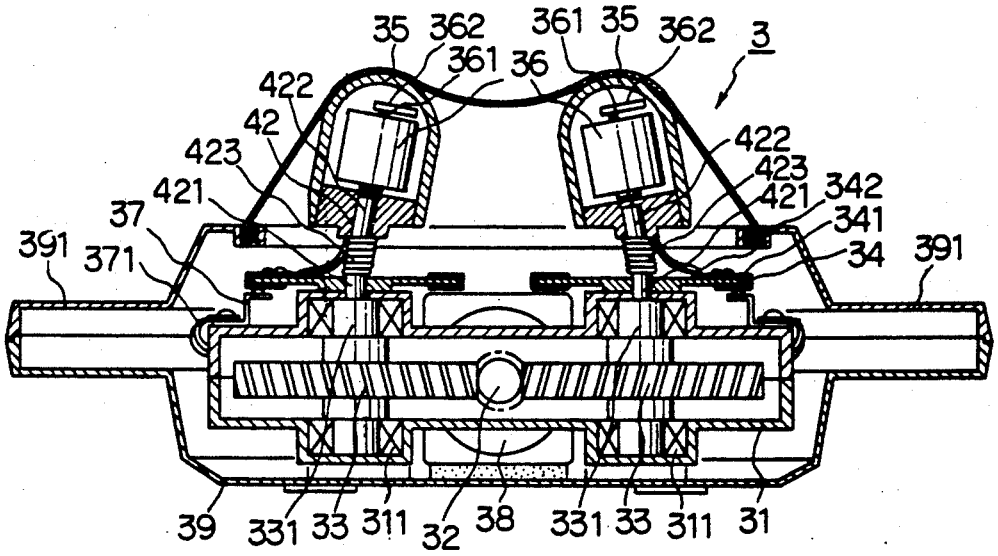
FIG. 8 is a central longitudinal sectional view of a second embodiment of a portable massager according to the present invention.
Figure 9:
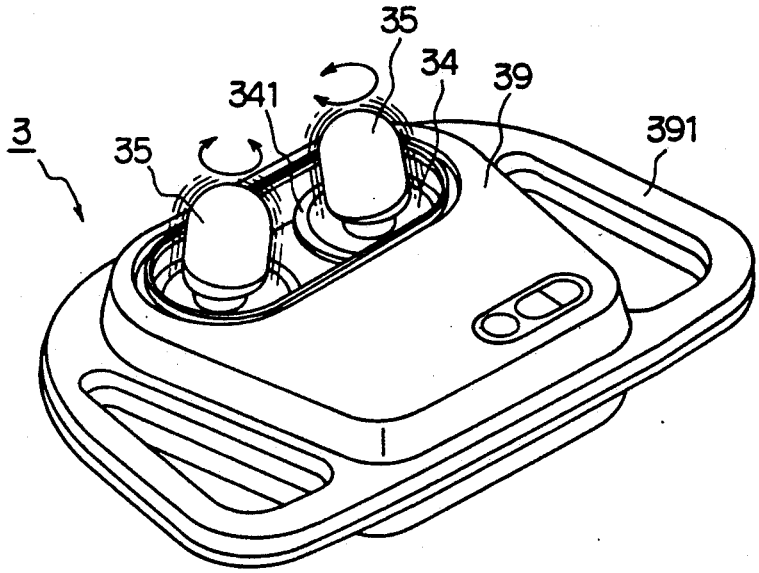
FIG. 9 is a plan view of a portable massager of the present invention in operation.

FIG. 8 illustrates another embodiment of the present invention in which a spring 423 is used to connect the second shaft 421 with a third shaft 422. The second shaft 421 is provided at the upper end of the first shaft 331 and extends vertically therefrom and the third shaft 422 is provided at a lower end of the massaging ball 35. The springs 423 prevent the massaging balls from binding or pinching a body part of the user during the operation of the portage massager as the springs will yield and deflect when more than a desired amount of force is applied to them. Other than the provision of the spring between the second shaft 421 and the third shaft 422, the construction of the second embodiment of the present invention is basically the same as the first embodiment.

The massaging balls 35 extend through the opening provided in the case body 39 so that they may be brought into contact with a desired body part. During operation, the small motor 36 may be started which rotates the motor shaft 361 and the eccentric weight 362 disposed on the end thereof to impart microvibration to the massaging ball and the affected body part. Additionally, when the motor 38 and the small motor 36 are engaged at the same time, the massaging balls make relative swinging motions along a circular path and also microvibrate. Through these actions, the portable massager of the present invention is capable of giving proper finger pressure vibration massage. Due to the springs 423 provided between the second shaft 421 and the third shaft 422, the binding or pinching of a body part by the rotating massaging balls 19 is avoided. Additionally, since the motor 36 can rotate in opposite direction, the massaging balls 35 can optionally massage in an upward or downward fashion.

What is claimed is:

1. A portable massager comprising a drive worm disposed in a box and a pair of worm gears engaged on opposite sides of the worm and disposed rotatably in the box, rotating disks which have electrical elements provided at an outer edge surface thereof are disposed above frames located above the worm gears, massaging balls are connected with the rotating disks at angles inclined relative to axes of rotation of said rotating disks, a small motor which has wiring connected to the electrical element of the respective rotating disk is disposed in each massaging ball, a weight is rotatably and eccentrically connected at a shaft end of the motor, and outgoing panels connected with an external power source by electrical connection means are disposed on an upper face of the box in contact with the electrical elements, whereby relative swing motion and microvibration of each massaging ball can be performed optionally or simultaneously.

2. A massager according to claim 1, wherein at least one upper or lower side of each worm gear is provided with a vibration isolation board which has a variable annular elastic height and engages with said at least one upper or lower side and an inner wall of the box at a constant pressure to minimize noise and vibration during rotation of the worm gear.

3. A massager according to claim 1, wherein at an upper end of the frame located above each worm gear, a thin shaft is divided into upper and lower parts connected through a spring, each lower part being mounted on the rotating disk, and the massaging ball being disposed on the upper parts.

* * * * *